US006435896B1

(12) United States Patent
Takatsuki

(10) Patent No.: US 6,435,896 B1
(45) Date of Patent: Aug. 20, 2002

(54) CONNECTOR WITH LOCKING PIECE AND RIBS CONFIGURED TO PREVENT PENETRATION OF WIRE BELOW LOCKING PIECE

(75) Inventor: Kozue Takatsuki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 45 days.

(21) Appl. No.: 09/639,666

(22) Filed: Aug. 16, 2000

(30) Foreign Application Priority Data

Sep. 28, 1999 (JP) ..... 11-274782

(51) Int. Cl.[7] ..... H01R 13/627
(52) U.S. Cl. ..... 439/354
(58) Field of Search ..... 439/352, 354, 439/357, 358

(56) References Cited

U.S. PATENT DOCUMENTS 5,324,208 A 6/1994 Kodama et al.
5,672,071 A * 9/1997 Ceru ..... 437/353
5,775,932 A * 7/1998 Saito et al. ..... 439/378
6,129,593 A * 10/2000 Aoyama et al. ..... 439/701
6,206,716 B1 * 3/2001 Saito ..... 439/352
6,217,365 B1 * 4/2001 Shimozaki ..... 439/358
6,227,896 B1 * 5/2001 Chang ..... 439/354
6,234,826 B1 * 5/2001 Wilber et al. ..... 439/352

* cited by examiner

*Primary Examiner*—Brian Sircus
*Assistant Examiner*—Thanh-Tam Le
(74) *Attorney, Agent, or Firm*—Anthony J. Casella; Gerald E. Hespos

(57) ABSTRACT

A vertically deformable elastic locking piece (4) is formed on the upper surface of the housing (2) and extends in a front-to-rear direction. An overhang (6) extends in right-to-left directions at the rear end of an upper surface of the locking piece (4). Inclined surfaces (8) incline toward the center of the housing (2) on lower surfaces of the overhang (6). Ribs (7) project upward from the upper surface of the housing (2) and extend along right and left sides of the locking piece (4). A thick portion (9) is formed on each rib (7) and narrows the gap (A) between the locking piece (4) and the rib (7). The gap (B) between an upper end (9A) of the thick portion (9) and the inclined surface (8) is smaller than the gap (A). Therefore, it is difficult for an electric wire that has penetrated into the gap (A) between the locking piece (4) and the rib (7) to pass through the gap (B) and penetrate into the space below a lower surface of the locking piece (4).

10 Claims, 7 Drawing Sheets

CONNECTOR WITH LOCKING PIECE AND RIBS CONFIGURED TO PREVENT PENETRATION OF WIRE BELOW LOCKING PIECE

BACKGROUND OF THE INVENTION

1. Field of the Invention

The present invention relates to a connector.

2. Description of the Related Art

FIG. 7 shows a connector 100, which also is disclosed in U.S. Pat. No. 5,324,208. The prior art connector 100 is provided with a locking piece 101 that projects from an upper surface of the connector 100 for keeping the connector 100 and a mating connector (not shown) connected with each other. An actuator 103 is formed at the rear end of the upper surface of the locking piece 101 to enable the locking piece 101 to be flexed.

A pair of ribs 102 projects upward from the upper surface of the connector 100 and extends in the front-to-back direction of the connector 100. The ribs 102 are positioned at both sides of the locking piece 101, and function to protect the locking piece 101.

In the connector 100, it is necessary to space the actuator 103 and each of the ribs 102 from each other at a predetermined gap 104 to permit an operation of pressing the locking piece 101 and for reasons of a molding die. The prior art connector 100 may be part of a wire harness, and may be packed in a case with other wire harnesses for transport to a location where the wire harnesses will be installed. In taking out a wire harness packed in a case, an electric wire W may drop into the gap 104 between the actuator 103 and each of the ribs 102 and may move into the space below the lower surface of the locking piece 101. As a result, there is a possibility that the rear portion of the locking piece 101 is pulled upward.

The present invention has been made in view of the above-described situation. Thus, it is an object of the present invention to provide a connector capable of preventing an electric wire that has penetrated into the gap between a locking piece and a rib from moving into the space formed below a lower surface of the locking piece.

SUMMARY OF THE INVENTION

The subject invention is directed to a connector having a housing capable of accommodating at least one metal terminal fitting therein, engaging. The housing includes an upper surface, and a locking piece is formed on the upper surface. The locking piece is configured to engage a mating housing and to keep both housings connected with each other. The upper surface of the housing further is provided with a pair of ribs. The ribs project from the housing along both sides of the locking piece. In this construction, an overhang projects upward from an end of an upper surface of the locking piece and laterally from both sides of the locking piece. A thick portion is formed on each of the ribs at a position below the overhang such that the thick portion narrows the width of a gap between the locking piece and the thick portion.

It is preferable that a tapered surface is formed on the peripheral edge of the locking piece.

According to the invention, even though an electric wire may penetrate into the gap between the locking piece and the rib, it is very difficult for the electric wire to move downward beyond the thick portion on the rib. Accordingly, it is possible to prevent the electric wire from penetrating into the space below the lower surface of the locking piece, and hence it is possible to prevent the locking piece from being bent in a direction upward and away from the housing.

DETAILED DESCRIPTION OF THE PREFERRED EMBODIMENTS

The construction of the connector of the present invention will be described below in detail with reference to FIGS. 1–6.

Figure 1:
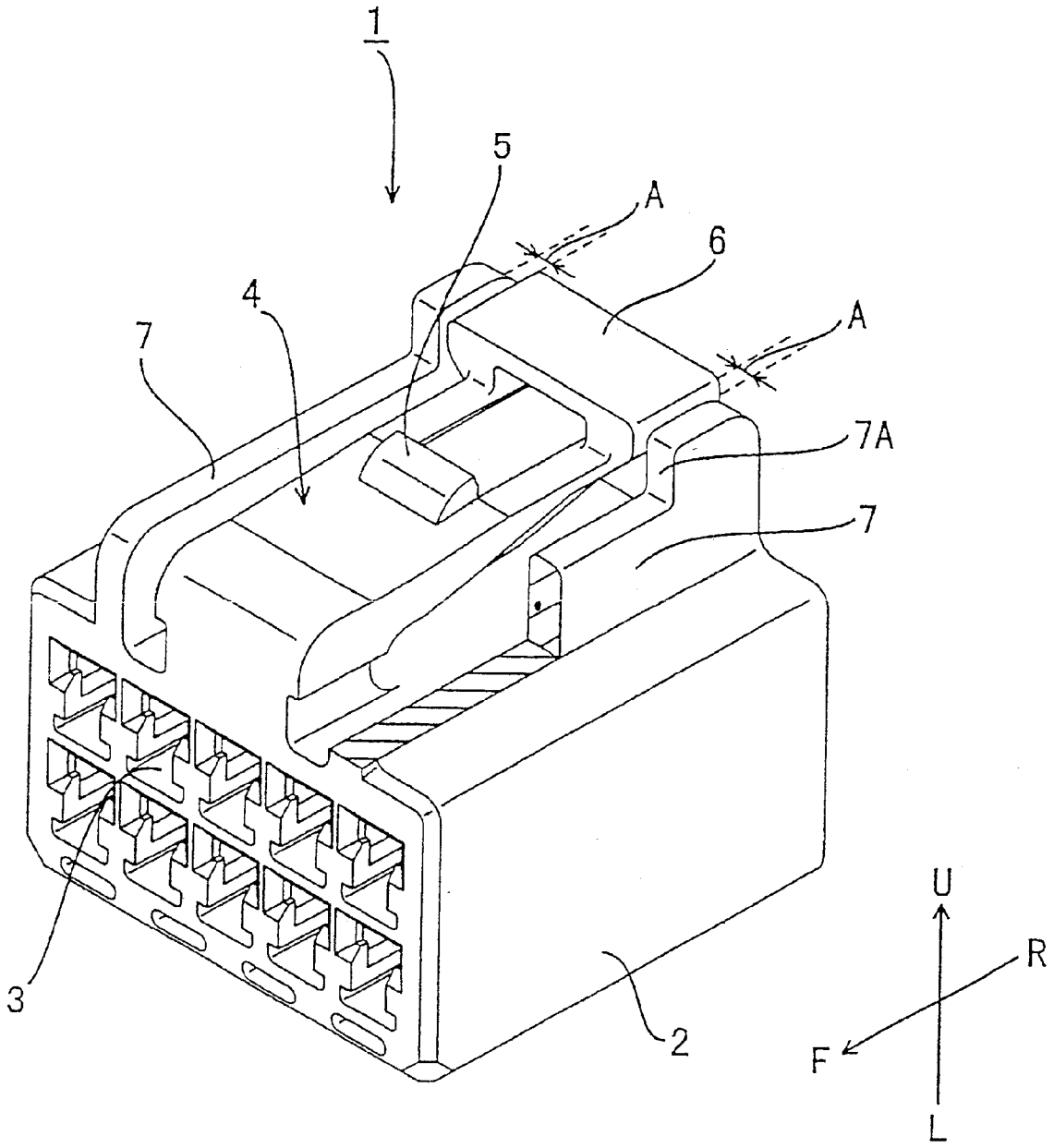
FIG. 1 is a partly cutout perspective view showing a connector of an embodiment of the present invention.
Figure 2:
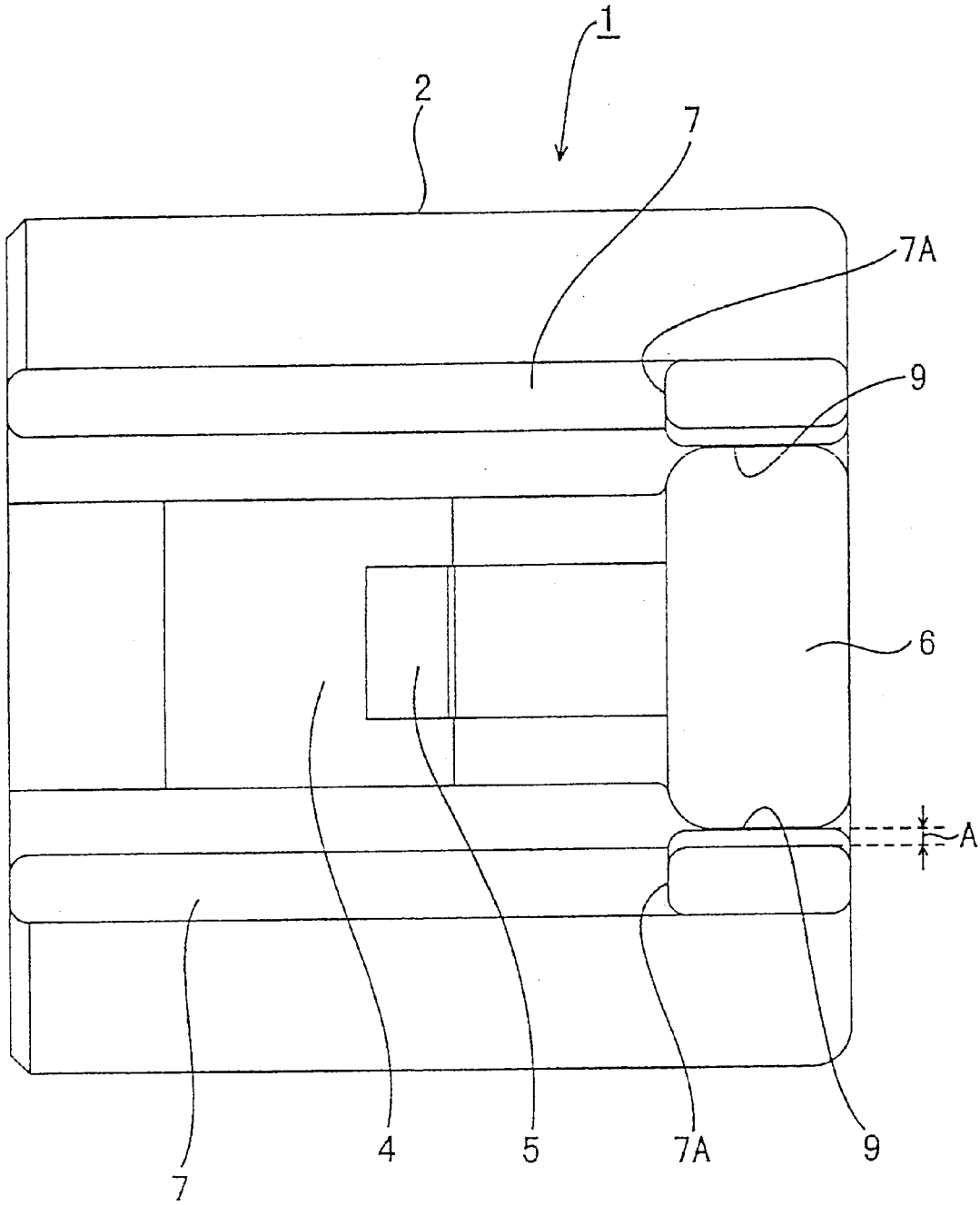
FIG. 2 is a plan view showing the connector.

FIG. 1 is a perspective view showing a connector 1 in accordance with one embodiment of the subject invention. In the following description, and in FIG. 1, arrows U, L, F and R are used to identify an upper direction (U), a lower direction (L), a front direction (F), and a rear direction (R), respectively.

Figure 5:
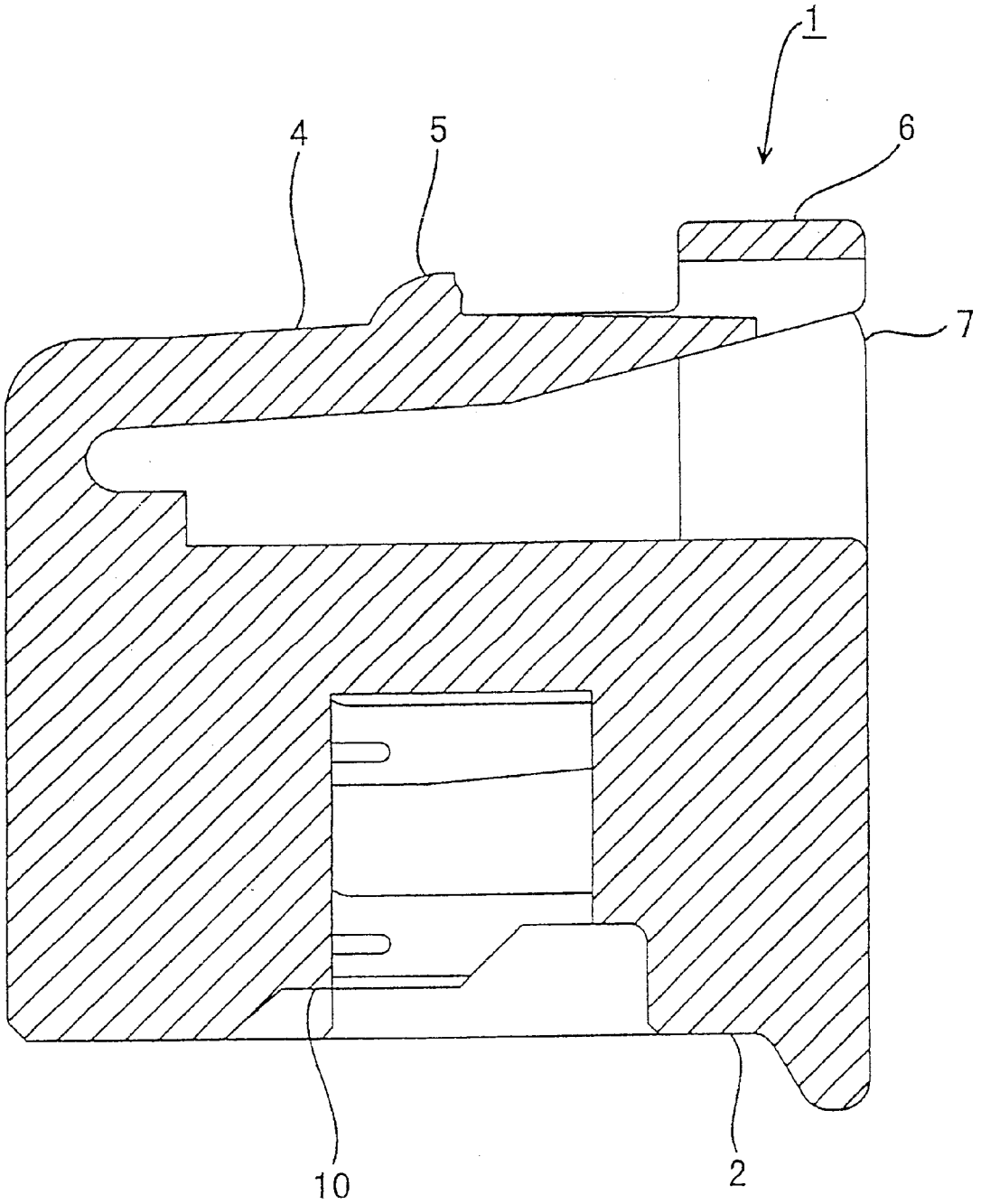
FIG. 5 is a side sectional view showing the connector.

The connector 1 has an approximately rectangular solid-shaped housing 2. Cavities 3 are formed inside the housing 2, and penetrate through the housing 2 in the front-to-rear direction. Female metal terminal fittings (not shown) can be mounted in the cavities 3. As shown in FIG. 5, a retainer-mounting opening 10 is formed on the lower surface of the housing 2, and communicates with the cavities 3. A retainer (not shown) can be mounted in the retainer-mounting opening 10 for locking the metal terminal fittings in the respective cavities.

A locking piece 4 is formed in the central portion of the upper surface of the housing 2, and extends in the front-to-rear direction. The front-end side of the locking piece 4 is connected to the housing 2. However, portions of the locking piece 4 that extend rearward from the front-end side are cantilevered. Thus the rear end side of the locking piece 4 is a free end, and a region of the locking piece 4 from its central portion to its free end portion is flexible vertically. A locking claw 5 projects upward from the central portion of the upper surface of the locking piece 4. The locking claw 5 engages an unshown mating housing, thus keeping both connectors connected with each other.

An overhang 6 is formed at the rear end of the upper surface of the locking piece 4, and extends in the left-to-right direction. The locking piece 4 can be flexed downward by pressing the overhang 6. The upper surface of the overhang 6 is approximately flat, while the lower surface of the overhang 6 is formed as inclined surfaces 8 that are inclined toward the center of the housing 2, as shown in FIGS. 1 and 4.

Two ribs 7 project upward from the upper surface of the housing 2 along the direction in which the locking piece 4 extends, such that the ribs 7 are positioned at right and left sides of the locking piece 4. The ribs 7 are approximately linear and extend in the front-to-back direction of the housing 2. A stepped portion 7A is formed on each rib 7 at its rear end such that the stepped portion 7A is higher than the other portions of the respective rib 7. The front end of each stepped portion 7A is almost flush with the front end of the overhang 6 of the locking piece 4. Gaps of predetermined dimensions A are provided in the spaces between the overhangs 6 and the respective ribs 7. The gap A is indispensable for preventing contact between the locking piece 4 and the rib 7, for allowing the locking piece 4 to flex vertically and also for convenience in shaping the housing 2 by a molding die.

Figure 3:
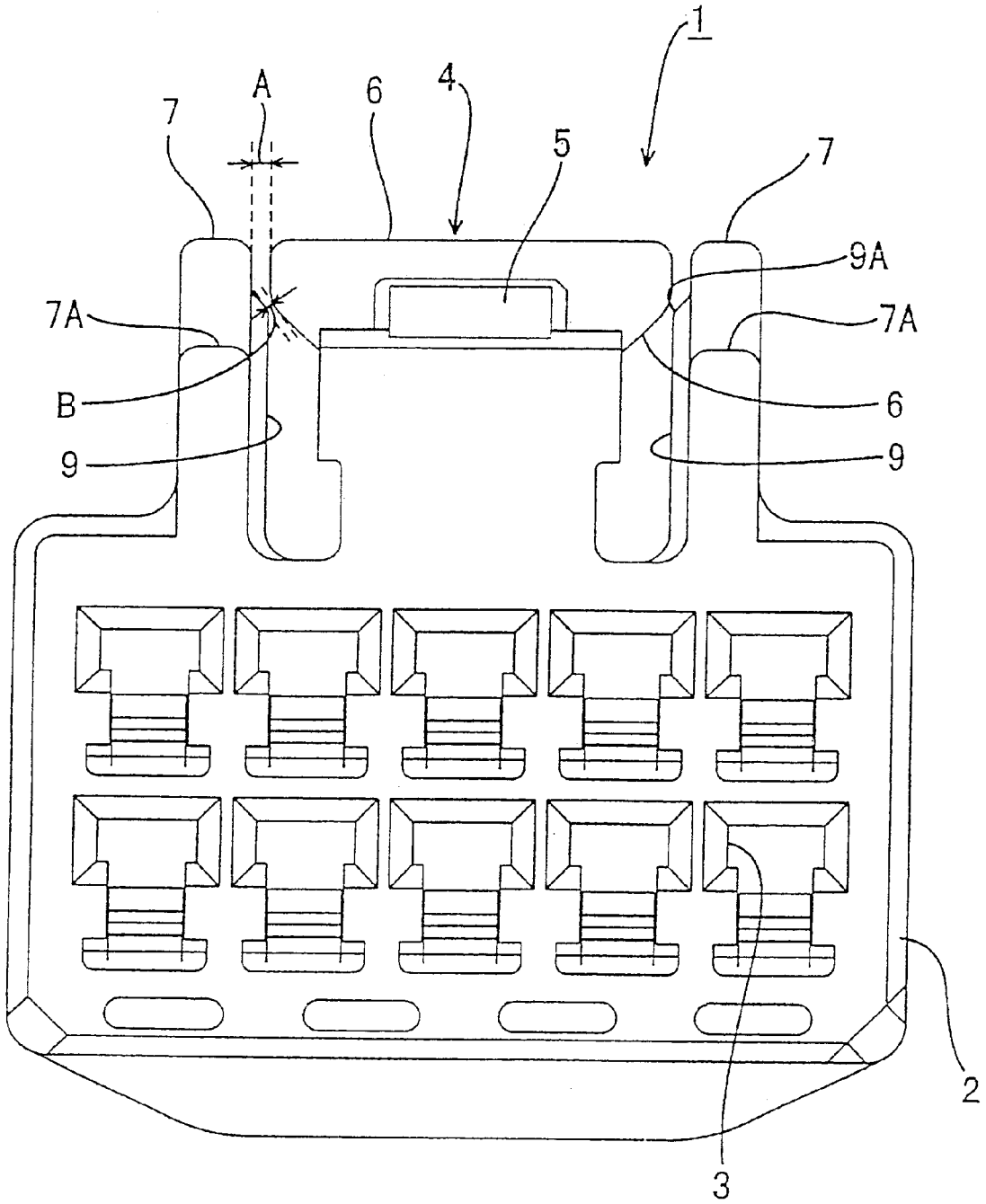
FIG. 3 is a front view showing the connector.
Figure 4:
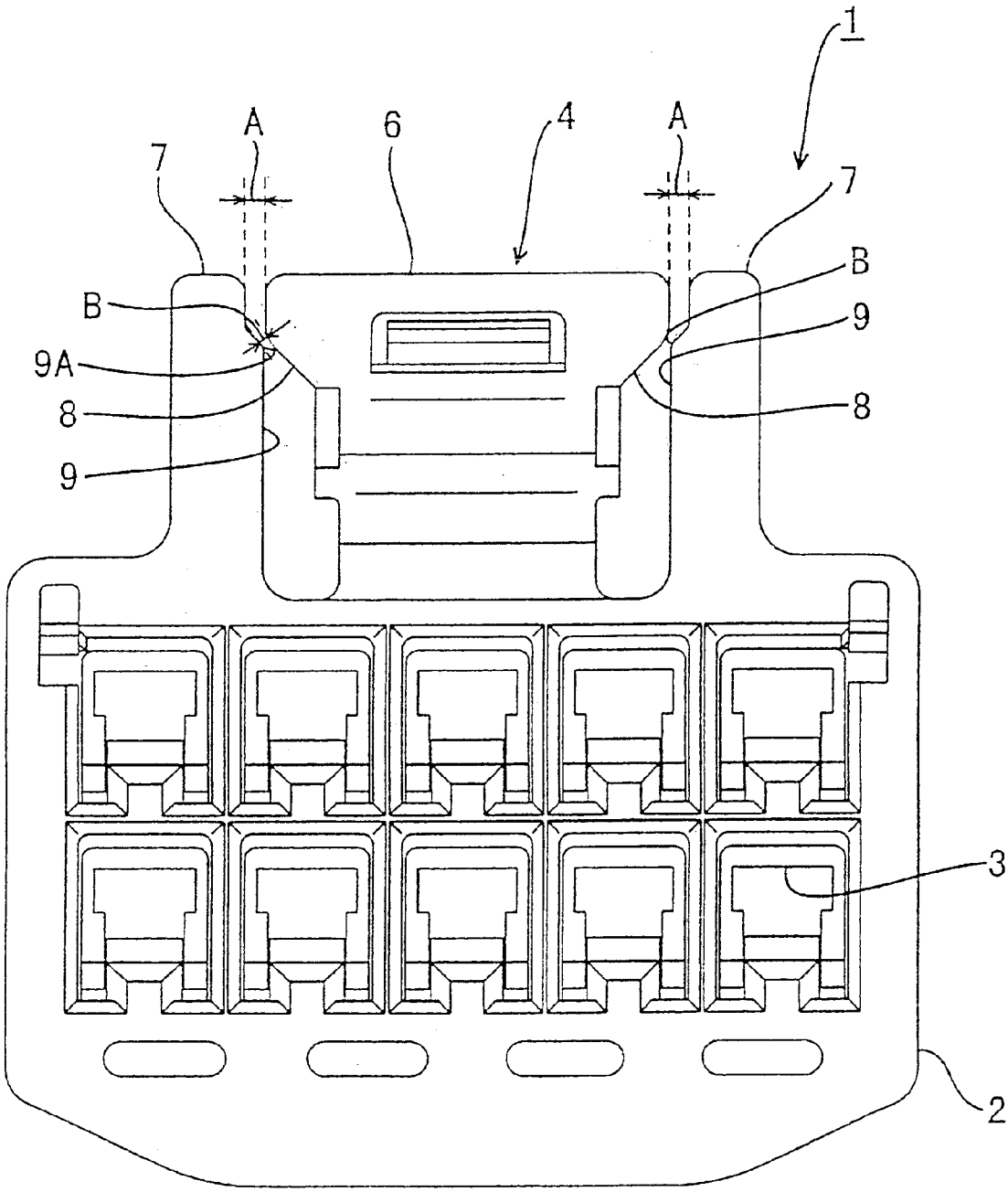
FIG. 4 is a rear view showing the connector.

FIGS. 3 and 4 show the locking piece 4 in a natural state, in which the locking piece 4 is not flexed vertically. A thick portion 9 is formed on the rib 7, and extends downward from a portion of the rib 7 at a level with the upper end of the inclined surface 8 of the overhang 6. Additionally the thick portion 9 extends toward the locking piece 4, such that the thick portion 9 confronts the locking piece 4. The distance between the opposed thick portions 9 is equal to or slightly greater than the width of the overhang. 6 to permit efficient vertical flexing of the locking arm 4 into the space between the thick portions 9. The upper end of the thick portion 9 is located on a level with the upper end of the inclined surface 8 of the overhang 6 or slightly upward above the upper end of the inclined surface 8 of the overhang 6. When the locking piece 4 is located in the natural state, the width of a shortest gap B at which an upper end 9A of the thick portion 9 and the inclined surface 8 are closest to each other is set smaller than the width of the gap A.

Figure 6:
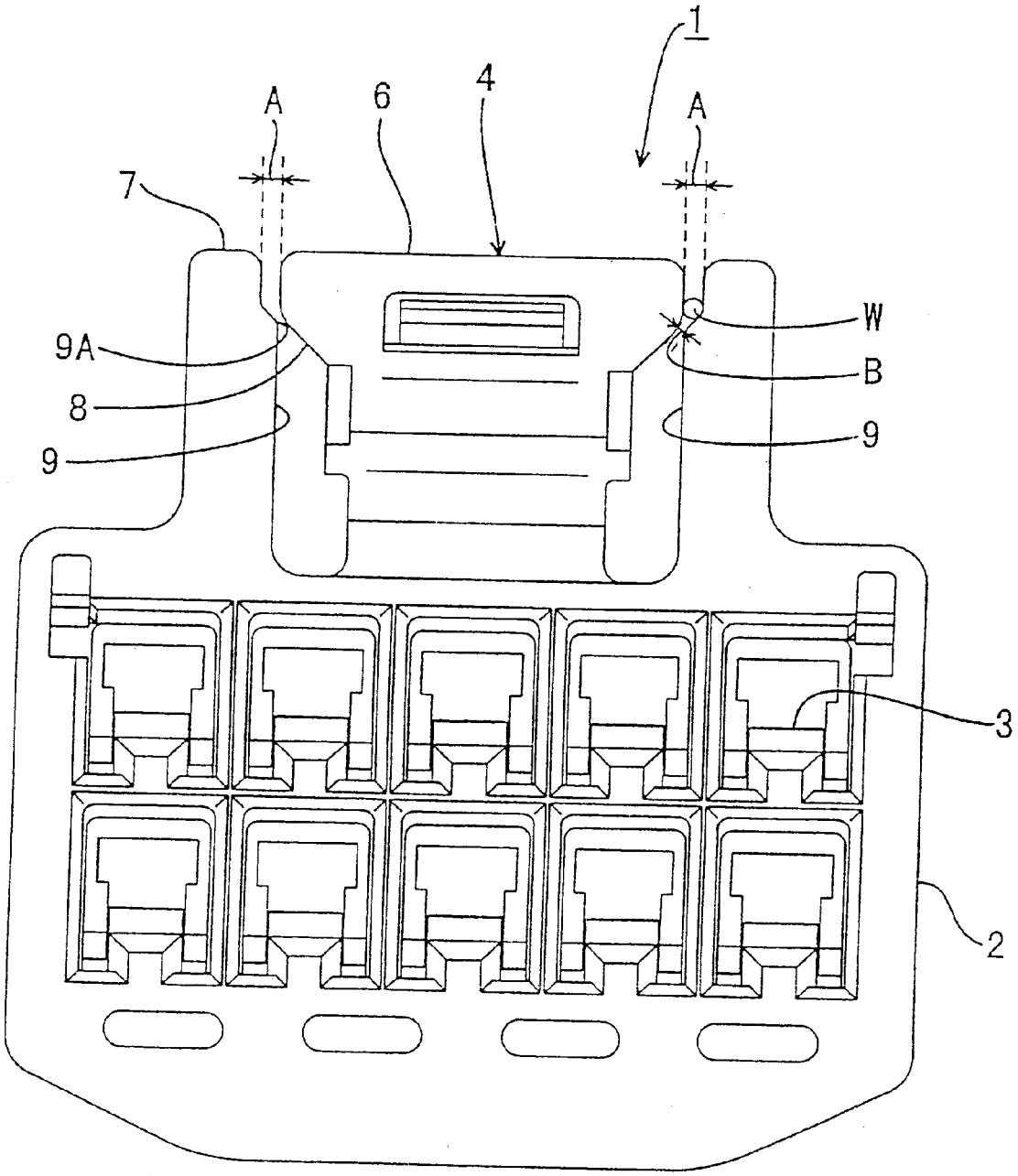
FIG. 6 is a rear view showing a state in which an electric wire is sandwiched between a locking piece and a rib when the connector is not connected with a mating connector.
Figure 7:
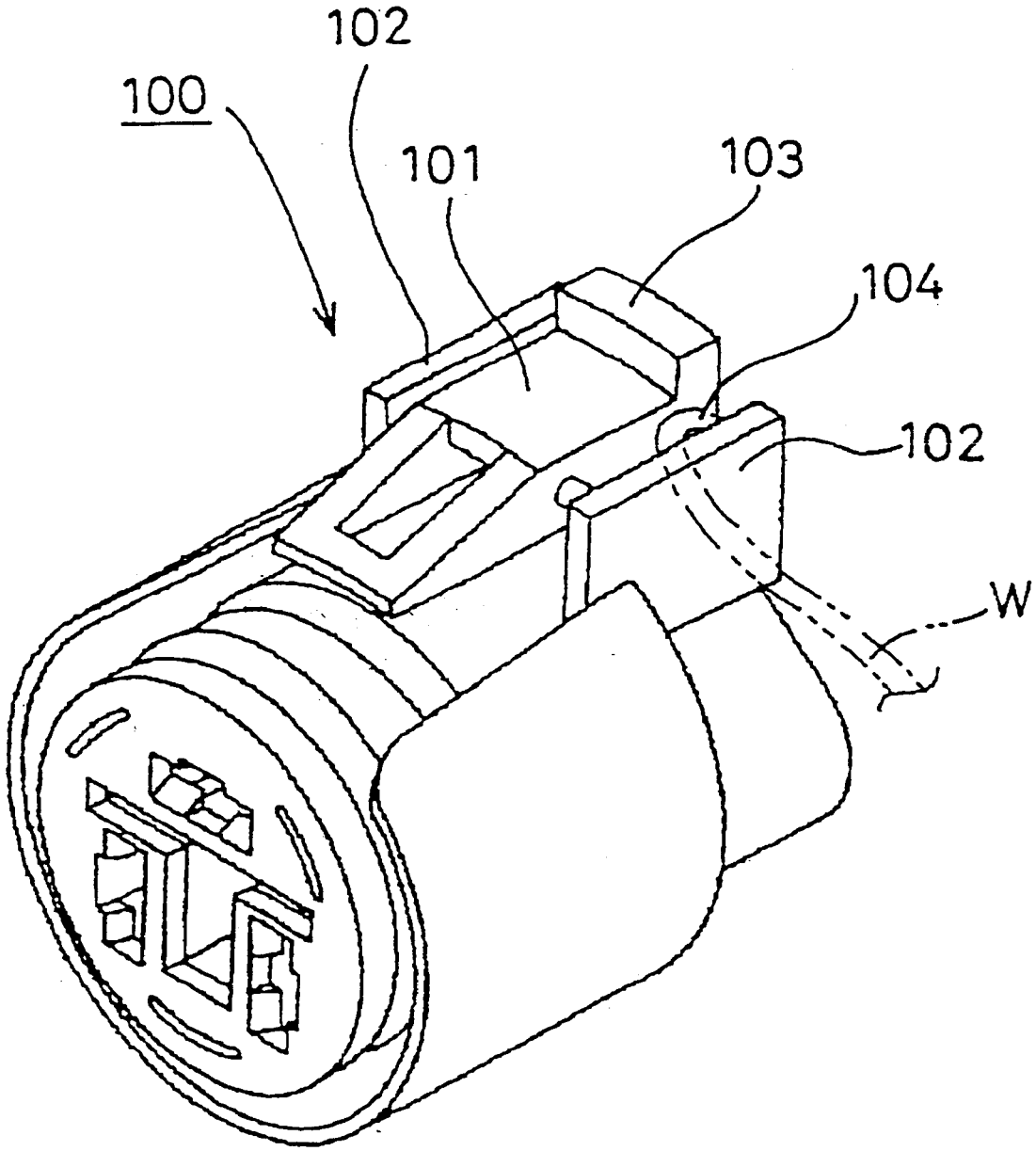
FIG. 7 (PRIOR ART)
FIG. 7 is a perspective view showing a conventional connector.

The operation and effect of the connector of the embodiment having the above-described construction are described below with reference to FIG. 6.

Let it be supposed that the connector 1 is not connected with the mating connector. If an electric wire W has penetrated into the gap A between the locking piece 4 and the rib 7, it moves downward in the gap A. As described above, however, the thick portion 9 is provided on the rib 7. Additionally, the width of the shortest gap B between the inclined surface 8 and the upper end 9A of the thick portion 9 is set smaller than that of the gap A provided in the space between the overhang 6 and the rib 7. Thus, it is very difficult for the electric wire W to move inward from the shortest gap B. Accordingly, it is possible to prevent the electric wire W from penetrating into the space below the lower side of the overhang 6, and hence it is possible to prevent the locking piece 4 from being lifted upward.

The technical scope of the present invention is not limited to the above-described embodiment. For example, the following modifications are included in the technical scope of the present invention. The technical scope of the present invention includes the scope of the equivalence.

The connector 1 of the preferred embodiment is a female connector. But according to the present invention, the connector 1 may be a male connector.

The locking piece 4 of the preferred embodiment is so shaped that only its front end is connected to the housing 2. But according to the present invention, the locking piece 4 may be so shaped that its central portion is connected to the housing 2.

What is claimed is:

1. A connector having a housing with an upper surface, the housing being capable of accommodating a metal terminal fitting therein, a locking piece being formed on the upper surface of the connector housing and being configured for engaging a mating housing and keeping said housings connected with each other; and a pair of ribs projecting from said housing and extending along opposite sides of said locking piece, wherein an overhang projects laterally from both sides of said locking piece; and each of said ribs being formed with a thick portion extending from the upper surface of the connector housing to a location below said overhang and a thin portion extending upwardly from the thick portion, such that said thick portions define a gap between said locking piece and said ribs that is less than the distance between said locking piece and said thin portions of said ribs.

2. A connector having a housing with an upper surface, the housing being capable of accommodating a metal terminal fitting therein, a locking piece being formed on the upper surface of the connector housing and being configured for engaging a mating housing and keeping said housings connected with each other; and a pair of ribs projecting from said housing and extending along opposite sides of said locking piece, wherein an overhang projects laterally from both sides of said locking piece; and a thick portion being formed on each of said ribs at a position thereof located below said overhang such that said thick portions narrow a gap between said locking piece and said ribs, and wherein an inclined surface inclined toward said locking piece is formed on a lower surface of said overhang; and a width of a gap at a position where said inclined surface and said thick portion are closest to each other is set smaller than a width of the gap provided between said overhang and said ribs, when said locking piece is not elastically deformed.

3. A connector according to claim 1, wherein the connector is unitarily molded from a plastic material.

4. A connector according to claim 1, wherein the thick portions of the ribs are spaced from one another by a selected distance, and wherein the overhang on the locking piece defines a selected width, the distance between the thick portions being no less than the width of the overhang.

5. A connector having a housing with an upper surface, the housing being capable of accommodating a metal terminal fitting therein, a locking piece being formed on the upper surface of the connector housing and being configured for engaging a mating housing and keeping said housings connected with each other; and a pair of ribs projecting from said housing and extending along opposite sides of said locking piece, wherein an overhang projects laterally from both sides of said locking piece; and a thick portion being formed on each of said ribs at a position thereof located below said overhang such that said thick portions narrow a gap between said locking piece and said ribs, and wherein the overhang includes a pair of opposed side surfaces aligned substantially parallel to the respective ribs and inclined surfaces extending downwardly and inwardly from the side surfaces, the thick portions of the respective ribs having top ends inclined upwardly and outwardly, the intersections of the respective side surfaces and the inclined surfaces of the overhang being approximately aligned with the inclined top ends of the thick portions on the ribs.

6. A connector according to claim 1, wherein the connector housing includes opposed front and rear ends, the locking piece being cantilevered from a location adjacent the front end of the connector housing and extending toward the rear end, the overhang being in proximity to the rear end of the housing.

7. A connector according to claim 6, wherein the locking piece includes a projection at a location intermediate said front and rear ends of said housing and forwardly of the overhang.

8. A connector according to claim 7, wherein the ribs each include a low portion extending rearwardly from the front end of the housing and a stepped portion adjacent the rear end of the housing and aligned with the overhang, the thick portions being disposed on the stepped portions of the ribs.

9. A connector having a housing with opposed front and rear ends and an upper surface extending between the ends, a deflectable locking piece being cantilevered from the upper surface of the housing and projecting toward the rear end of the housing, a locking projection being formed on the locking piece for locking engagement with a mating connector, the locking piece being formed with an overhang at a location thereon in proximity to the rear end of the housing, the overhang projecting upwardly and laterally beyond portions of the locking piece disposed forwardly of the overhang to define a selected width, portions of the overhang facing the upper surface of the housing defining inclined surfaces tapered downwardly toward the upper surface of the housing and inwardly toward one another, ribs disposed on opposite respective sides of the locking piece and being spaced from one another by a gap sufficiently greater than the width of the overhang to permit deflection of the locking piece, a thick portion being formed on portions of each of the ribs facing the locking piece, the thick portions defining a gap relative to the inclined surfaces that is narrower than the gap between the ribs and the side surfaces of the overhang.

10. A connector according to claim 9, wherein the thick portions of the ribs are spaced from one another by a distance no less than the width of the overhang.

* * * * *